US005761814A

United States Patent [19]

Anderson et al.

[11] Patent Number: 5,761,814

[45] Date of Patent: Jun. 9, 1998

[54] RAZOR CONSTRUCTION

[75] Inventors: Katherine Anderson, Somerville; Ralph Kenneth Maider, Jr., Medfield; Paul Nowak, Danvers; Tzu-Jun Yen, Somerville, all of Mass.

[73] Assignee: The Gillette Company, Boston, Mass.

[21] Appl. No.: 685,267

[22] Filed: Jul. 23, 1996

Related U.S. Application Data

[63] Continuation of Ser. No. 317,036, Oct. 3, 1994, abandoned.

[51] Int. Cl.[6] ..... B26B 21/40

[52] U.S. Cl. ..... 30/50; 30/76; 30/77

[58] Field of Search ..... 30/76, 77, 84, 30/50

[56] References Cited

U.S. PATENT DOCUMENTS

| | | | |
|---|---|---|---|
| 1,290,641 | 1/1919 | Monroe | 30/84 |
| 1,890,334 | 12/1932 | Muros | 30/84 |
| 1,911,996 | 5/1933 | Gaisman | 30/84 |
| 4,270,268 | 6/1981 | Jacobson . | |
| 4,378,633 | 4/1983 | Jacobson . | |
| 4,378,634 | 4/1983 | Jacobson . | |
| 4,442,598 | 4/1984 | Jacobson . | |
| 4,488,357 | 12/1984 | Jacobson . | |
| 4,492,024 | 1/1985 | Jacobson . | |
| 4,492,025 | 1/1985 | Jacobson . | |
| 4,498,235 | 2/1985 | Jacobson . | |
| 4,551,916 | 11/1985 | Jacobson . | |
| 4,573,266 | 3/1986 | Jacobson . | |
| 4,621,424 | 11/1986 | Jacobson . | |
| 5,063,667 | 11/1991 | Jacobson . | |

FOREIGN PATENT DOCUMENTS

| | | | |
|---|---|---|---|
| 4313371 | 10/1993 | Germany | 30/50 |
| 416377 | 1/1967 | Switzerland | 30/77 |
| 1587317 | 4/1981 | United Kingdom . | |
| 94011163 | 5/1994 | WIPO | 30/50 |

*Primary Examiner*—Maurina T. Rachuba

*Attorney, Agent, or Firm*—Aubrey C. Brine; Edward S. Podzus; Donal B. Tobin

[57] ABSTRACT

A razor blade assembly has a body member containing blade means which may be resiliently mounted and biased outwardly from the body member. A wrap-around clip is provided at both sides of the body member, the clip having its ends terminating at the bottom surface of the body member. Means are provided for inhibiting movement of the clip ends relative to the bottom surface upon impact loading of the razor blade assembly.

12 Claims, 6 Drawing Sheets

RAZOR CONSTRUCTION

This application is a continuation of application Ser. No. 8/317,036 filed on Oct. 3, 1994 , now abandoned.

BACKGROUND OF THE INVENTION

The present invention relates to a safety razor construction and more particularly to the construction of a safety razor having a blade or blades which are independently movable in response to forces encountered during the shaving operation.

In U.S. Pat. Nos. 4,442,598, issued Apr. 17, 1984; 4,492,024, issued Jan. 8, 1985; 4,586,255, issued May 6th, 1986; and 4,551,916, issued Nov. 12, 1985, all in the name of Chester F. Jacobson, each assigned to the assignee of the present invention, razor constructions are shown wherein the blade members are independently movable in response to forces encountered during the shaving operation by virtue of their being supported by spring fingers. The spring fingers which may be independent entities or formed integral with the body of the razor structure both act as support for the blades and as biasing members which exercise a force against the blades outwardly from the razor blade body during the shaving operation.

In each of these constructions, the blade ends are retained in slots in the razor body and together with any guard portions which are separate from the body structure of the razor are held in place by retaining clips which hold the blades downwardly onto the spring fingers. The clips are generally two in number and retain either side of the razor blade body. The clip is wrapped about the razor blade body and its ends are disposed at the opposite side of the razor blade body from that of the blade cutting edges.

While the construction shown in the aforementioned patents has provided both a successful product, and ease of manufacture, in the event of a strong shock to the razor construction caused by inadvertently striking the razor assembly against an object, or dropping of the razor, the possibility exists that the ends of the clips would be caused to move away from one another and thereby jeopardize the integrity of the razor blade body construction.

It is therefore an object of the present invention to provide a razor blade assembly of the type discussed above in which the orientation of the blades and other elements retained in the razor body member remain in proper orientation during usage of the razor.

A further object of the invention is to provide a razor blade assembly wherein the various elements of the assembly are retained in proper orientation in the event of an accidental impact to the assembly.

Yet another object of the invention is to provide a razor blade assembly which is simple in construction and easy to manufacture, yet has the ability to retain proper orientation of its various elements during usage.

SUMMARY OF THE INVENTION

The aforementioned objects, and other objectives which will become apparent as the description proceeds are accomplished by providing a razor blade assembly comprising a body member having a pair of slotted openings formed therein at side portions of the body member and a razor blade disposed in the opening which blade is spring-biased upwardly from the body member. A pair of clips are disposed at either side portion of the body member, each clip enveloping a side portion of the slotted opening to retain the blade in the slotted opening against the spring bias. The clip has end portions terminating along a bottom surface of the body member side portion and means are provided for inhibiting movement of the clip ends along the direction of the body member bottom portion.

The means for inhibiting movement of the clip end may comprise an interfitting engagement between a clip end surface and the body member bottom surface one of the surfaces having a contoured boss extending outwardly therefrom and a corresponding contoured opening being formed in the surface of the other for receiving the boss. The boss is generally formed on the body member bottom surface and the contoured opening formed in the clip end.

The boss may be formed of a cylindrical surface extending toward and received in one edge of the clip end.

The boss however may be cylindrical and the clip end be provided with a circular opening formed therein for receiving the boss.

In another form the means for inhibiting movement of the clips ends comprises an opening formed in the body member bottom surface and the clip end is formed for interfitting engagement in the opening.

Additionally the razor blade assembly may contain at least one other slotted opening formed in the body member and having a razor blade disposed therein which is also spring-biased upwardly from the body member.

The spring-biasing elements may be spring fingers formed in the body member which contact each of the razor blades to force the blades upwardly into contact with each of the clips.

BRIEF DESCRIPTION OF THE DRAWING

The foregoing and other features of the invention will be more particularly described in connection with the preferred embodiments, and with reference to the accompanying drawing, wherein.

DESCRIPTION OF THE PREFERRED EMBODIMENTS

Figure 1:
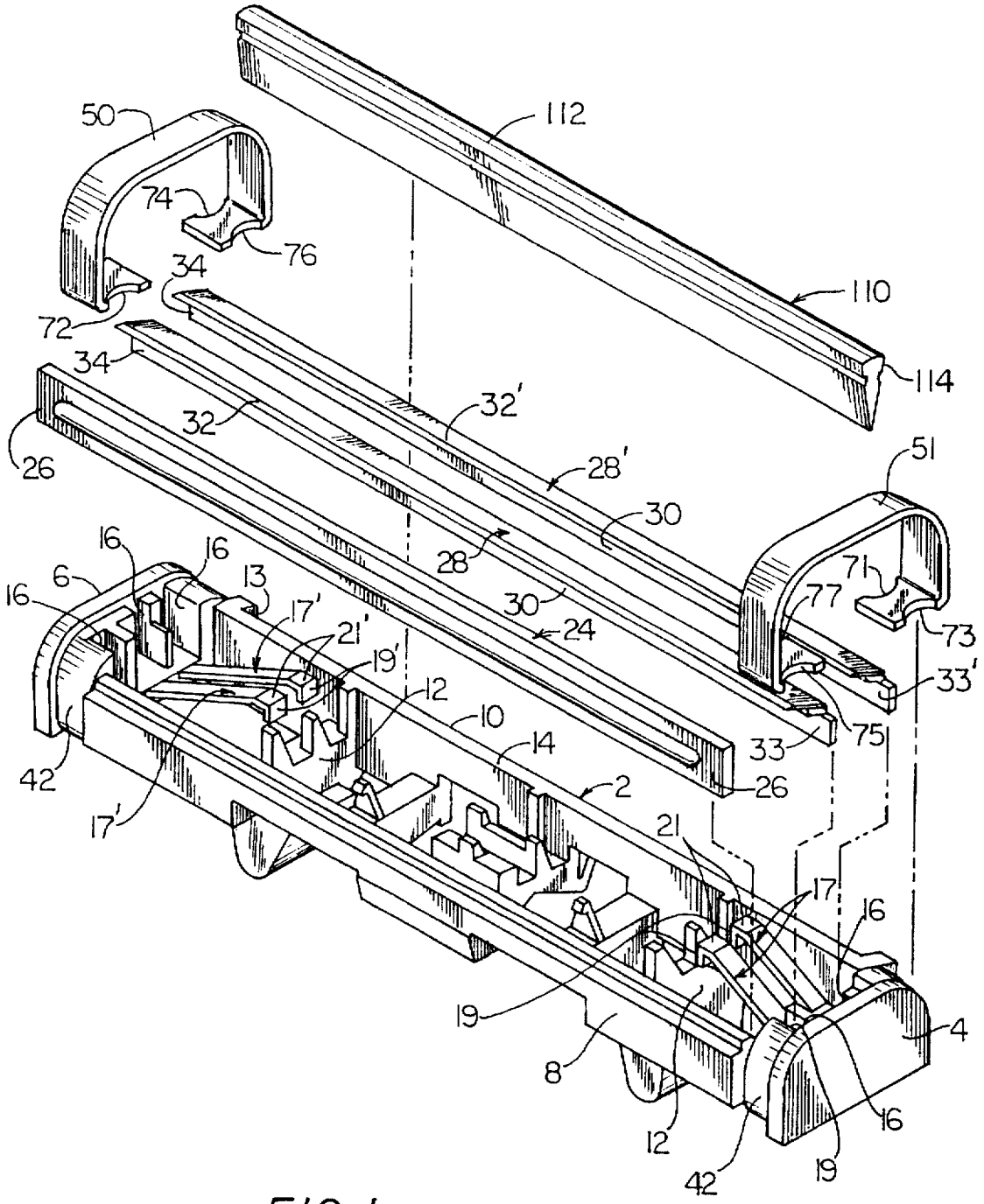
FIG. 1 is an exploded elevational perspective view showing a razor blade assembly constructed in accordance with the teachings of the present invention.

Referring now to the drawing and in particular to FIGS. 1 through 5 there is shown a blade assembly comprising a body member 2 have a first end portion 4 and a second end portion 6 interconnected by front and back portions 8 and 10 respectively. The back portion 10 of the body member 2 has an upper surface portion 14 which engages the skin being shaved behind the blade means of the assembly.

Frame portions 12 extend widthwise of the body member interconnecting the front and back portions 8 and 10 and each of the end portions 4, 6 is provided with opposed slots 16 disposed transversely to the frame portions 12.

The first end portion 4 is provided with integrally molded spring fingers 17 extending therefrom inwardly and upwardly of the body member, as viewed in FIG. 1. Each of the fingers 17 is provided with an end portion 19 having an upper surface 21. In like manner, the second end portion 6 is provided with spring fingers 17' of similar configuration with end portions 19' having upper surfaces 21'. The fingers 17, 17' extend in generally opposite directions, the fingers 17 extending from the first end portion 4 generally towards the second end portion 6, and the fingers 17' extending from the second end portion 6 generally toward the first end portion 4. The finger 17, 17' are each aligned with a pair of slots 16.

Figure 2:
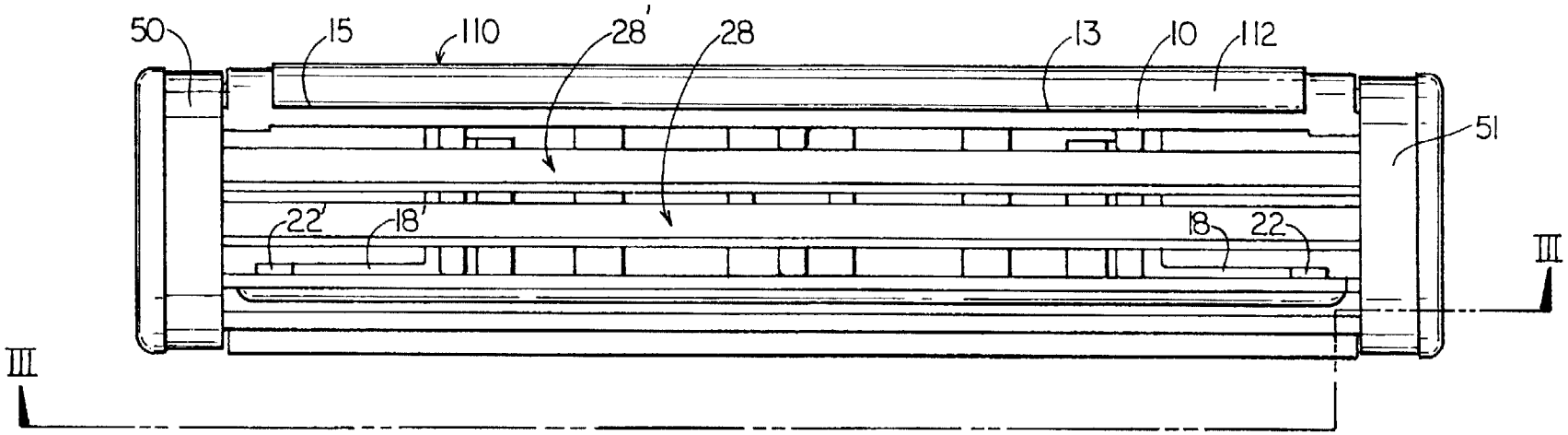
FIG. 2 is a top plan view showing the razor blade assembly of FIG. 1 in the assembled form.
Figure 3:
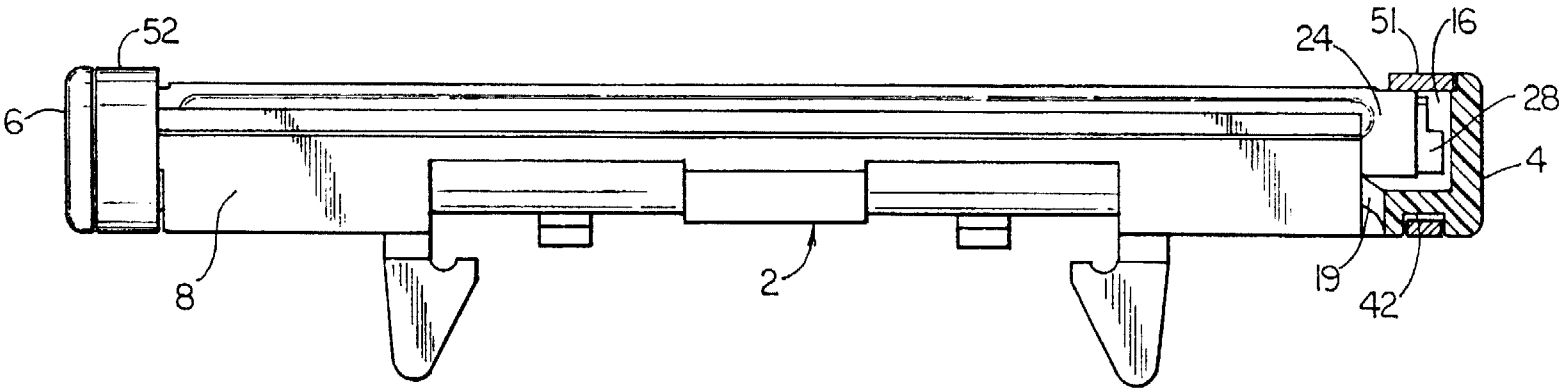
FIG. 3 is a front elevational view, partly in section taken along the line III—III of FIG. 2 and showing details of the razor blade assembly of FIG. 2.

The assembly includes a guard portion 24 having slidable portions 26 at either end thereof which are received in a pair of opposed slots 16 nearest the front portion 8, and the bottom of the guard portion 24 rests upon the surface of 22 and 22' of a pair of oppositely projecting spring fingers 18, 18' which extend outwardly and upwardly from the base of a respective frame portion 12, as shown in FIG. 2. The spring fingers 18, 18' supporting the guard portion 24 comprise a set of support members, the object of which is to resiliently support the guard portion. In a shaving operation the guard portion 24 travels over the surface being shaved ahead of the blade means.

The assembly further includes blade means 28 each blade comprising a blade base portion 30 and a cutting edge portion 32 extending from the base portion and end portions 33 and 34. Each of the end portions 33 and 34 are received slidably into a respective opposed slot 16 and the bottom of the base portion 30 rests on the surface 21 or 21' of the spring finger 19 or 19' respectively. The back portion 10 of the body member 2 is provided with a elongated opening 13 as best shown in FIG. 2 which has an insert member 110 having a top surface 112 rounding into a rear surface 114 to generally form a continuation of the back portion 10 upper and rear surface portions. The insert member 110 preferably is elongated extending over a majority of the length of the blade assembly and is permanently lodged in the opening 13.

The guard portion 24 and the first and second blades 28 and 28' are held in place by a pair of resilient spring clips 50 and 51 which are received in slots 42 in the end portions 4 and 6. The clips 50 and 51 engage the guard portion 24 and blades 28 and 28' forcing them into the slot 16 to a point where slight stress is placed onto the spring fingers 22 and 22' at the guard portion, and on the spring fingers 17 and 17' contacting the bottom edge of the base portions 30 of the blades 28 and 28'.

The aforementioned assembly is similar to that disclosed in U.S. Pat. No. 4,586,255, issued to Chester F. Jacobson and assigned to the assignee of the present invention, as well as those patents previously referred to, with the exception of the novel clips 50, 51, and their attachment to the body member 2, which will be described in detail below.

Figure 4:
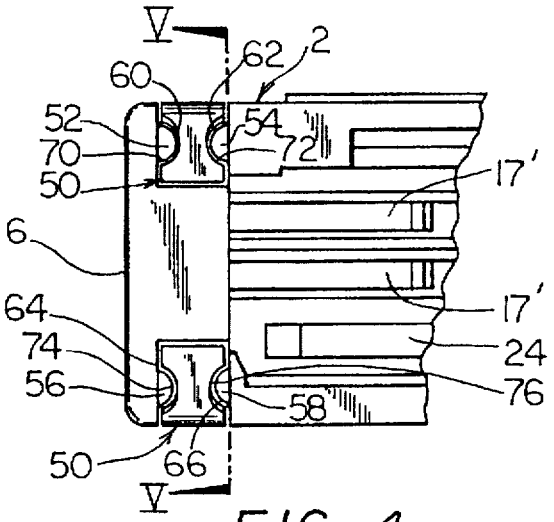
FIG. 4 is a fragmentary bottom plan view having portions removed, and showing further details of the structure of FIGS. 1, 2 and 3 taken on an enlarged scale for clarity.
Figure 5:
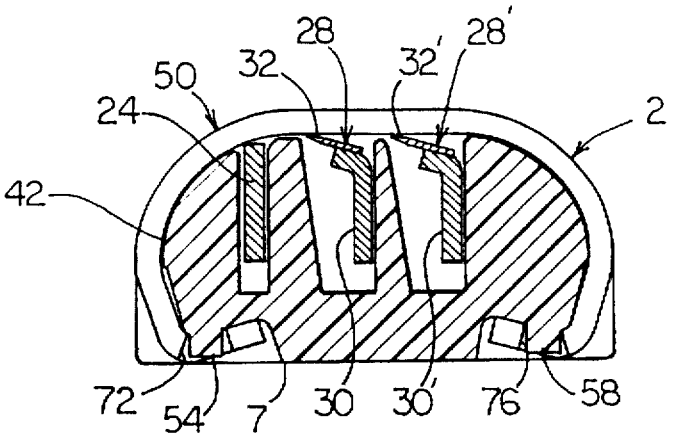
FIG. 5 is an elevational sectional view taken along the line V—V of FIG. 4 and rotated 90°, showing details of that portion of the structure.

Referring now to FIGS. 4 and 5 it will be noted that the end portion 6 of the body member 2 has a plurality of contoured bosses 52, 54, 56, and 58 which extend outwardly from the bottom surface of the body member and have a radial surface 60, 62, 64, and 66 each radial surface facing an opposed radial surface. The clip 50 has a pair of radial cutouts 70, 72, 74, and 76 which receive the bosses 52, 54, 56, and 58 when the clip is received in interfitting engagement within the groove 42.

It should be noted that the clip 51 also is provided with radial cutouts 71, 73, 75 and 77 the construction of the clip 51 being identical to that of the construction of the clip 50, and the construction of the body member 2 being formed at the end portion 4 in an identical manner to that as shown at the end portion 6 so as to receive the clip 51 as described above.

With the clip 50 formed in the manner shown, and the clip ends received over the contoured bosses 52, 54, 56 and 58, movement of the clip ends along the direction of the body member bottom surface is inhibited should the body member 2 be subjected to a sudden shock due to being dropped or struck against a surface inadvertently during the shaving process.

Figure 6:
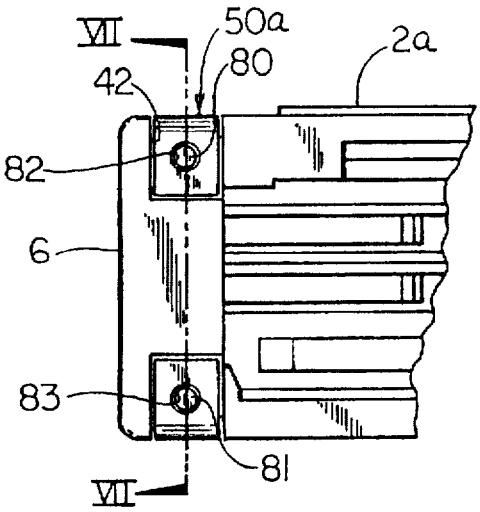
FIG. 6 is a bottom plan view similar to FIG. 4 showing an alternate embodiment of the invention.
Figure 7:
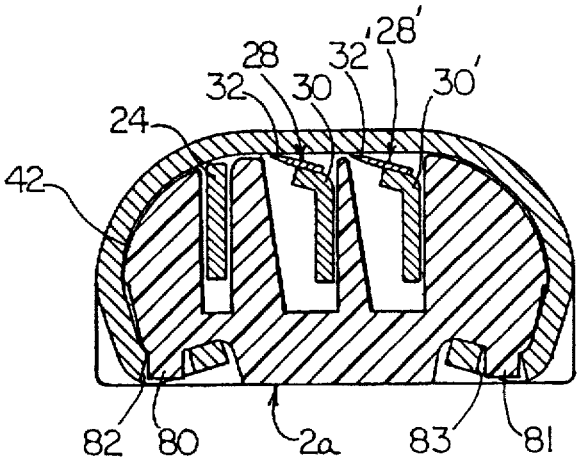
FIG. 7 is an elevational sectional view taken along the line VII—VII of FIG. 6 and rotated through 90°, showing details of the structure of FIG. 6.

Referring now to FIGS. 6 and 7 there is shown an alternate embodiment of the structure, wherein a pair a clips 50*a* and 51*a* are provided on a body member 2*a* which is constructed in order to receive the clips 50*a* and 51*a* (51*a* not shown) it being understood that all other elements of the razor blade assembly are identical to those shown in FIG. 1. The bottom surface of the body member 2*a* at the slots 42 is provided with a pair of bosses 80 and 81 which extend outwardly from the bottom surface of the body member 2*a* and are cylindrical in configuration. At either end of the clip 50*a* a circular opening 82 and 83 is formed which receive the bosses 80 and 81 in interfitting engagement in a similar manner to the bosses 52, 54, 56 and 58 of the previous embodiment. It should again be understood that at the opposite end portion 4 of the body member 2*a* an identical structure to that shown in FIGS. 6 and 7 is provided to secure that end of the body member in the manner described with reference to the clip 50*a* and the bosses 80 and 81.

Figure 8:
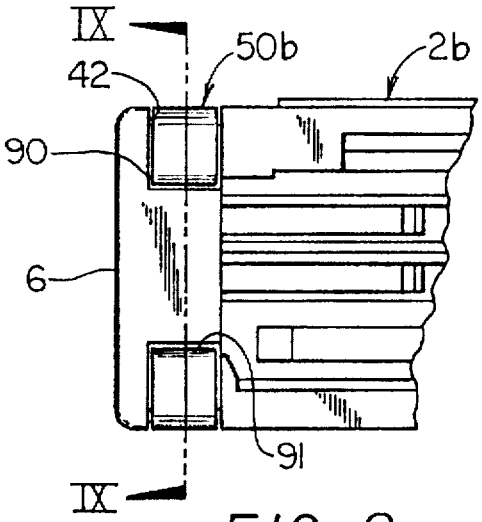
FIG. 8 is a bottom plan view similar to FIGS. 4 and 6 showing still another embodiment of the invention.
Figure 9:
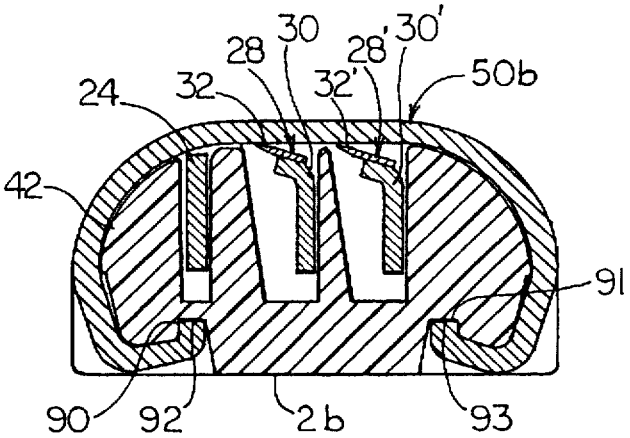
FIG. 9 is an elevational sectional view taken along the line IX—IX of FIG. 8, and rotated through 90°, showing details of that structure.

Referring to FIGS. 8 and 9, another alternative embodiment of the invention is disclosed wherein a clip 50*b* is employed at either end portion 4 or end portion 6 of a body member 2*b* which is constructed so as to receive the clip 50*b*, all other elements of the razor blade assembly being identical to those described with reference to the body members 2 and 2*a*. As shown in FIGS. 8 and 9, the clip 50*b*has end portions formed into flanges 90 and 91, and slotted openings 92 and 93 are formed in the bottom surface of the body member 2*b* at the slot 42 for interfitting engagement with the flanges 90 and 91.

Figure 10:
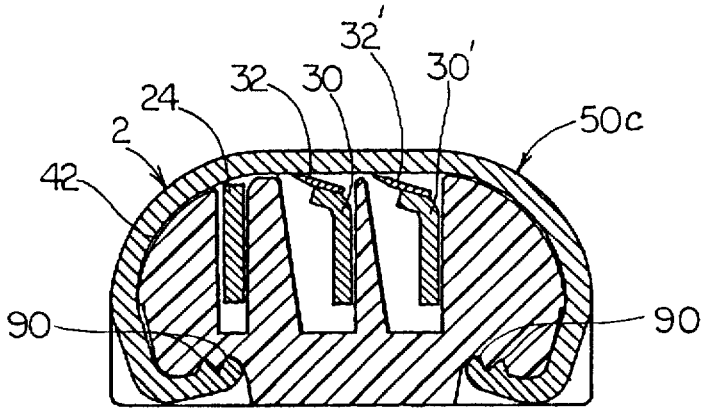
FIG. 10 is an elevational sectional view similar to FIGS. 5, 7 and 9 showing details of a further alternate embodiment of the invention.

In FIG. 10, details of a further alternate embodiment are shown wherein a clip 50*c* is assembled at the end portions 4 and 6 of a body member 2*c*. The clip 50*c* is provided with a plurality of barbs 90 which are forced into the bottom surface of the body member during assembly of the structure. The barbs 90 may be of any required number and are generally formed at the edge of the clip 50*c* near the clip end, or may be formed on the clip surface facing the bottom surface of the body member.

In each of the embodiments shown the engagement of the end of the clips 50, 50*a*, 50*b* or 50*c* with the bottom surface of the body member 2, 2*a*, 2*b* or 2*c* is one which inhibits movement of the clip end along the direction of the body member bottom surface and therefore retains the integrity of the elements being clamped by the respective clip insuring the integrity of the structure should the structure be inadvertently dropped or hit on an object during usage or storage.

In tests conducted employing the embodiment of FIGS. 1 through 5, a measured load was deliberately applied to the underside of the structure at the guard and blade spring fingers. Of five samples tested, the load required to pop a clip off an assembly in each instance was greater than that measured in a test of five samples having plain ends, as in the prior art. In a further test in which five assemblies constructed in accordance with the embodiment of FIGS. 1 through 5 were disposed on a razor handle and deliberately dropped onto a tile surface from a height of sixty inches with the razor assembly striking the surface, all five samples remained undamaged, while only two of five assemblies constructed with prior art clips remained intact. It is therefore considered that the construction inhibiting clip end movement relative to the bottom surface of the body member provides a marked improvement over prior art structures which is simply and economically achieved.

While it is apparent that changes and modifications can be made within the spirit and scope of the present invention, it is our intention, however, only to be limited by the appended claims.

As our invention we claim:

1. A razor blade assembly comprising:

a body member having at least one pair of slotted openings formed therein, one of said slotted openings being disposed at each of opposite side portions of said body member;

a razor blade disposed in said openings;

a pair of clips one disposed at one side portion and another disposed at the opposite side portion of said body member;

each said clip enveloping a respective said side portion and covering a portion of said slotted opening and extending completely across said blade in a direction transverse to the extent of said blade in the area of said slotted opening to retain said blade in said slotted opening;

each said clip further having a pair of end portions terminating along a bottom surface of its respective said body member side portion; and means disposed adjacent each of said end portions for inhibiting movement of one of said pair of clip end portions relative to said body member bottom surface in a direction transverse to the longitudinal direction of said blade to prevent separation of said pair of clip end portions one from the other.

2. A razor blade assembly as set forth in claim 1 wherein said means for inhibiting said movement of a said pair of clip end portions comprises an interfitting engagement between a clip end portion surface and said body member bottom surface, one of said surfaces having a contoured boss extending outwardly therefrom and a corresponding contoured opening formed in the surface of the other for receiving said boss.

3. A razor blade assembly as set forth in claim 2 wherein said boss is formed on said body member bottom surface and said contoured opening is formed in said clip end portion.

4. A razor blade assembly as set forth in claim 3 wherein said boss is formed of a radial surface extending toward, and received in an edge of said clip end portion.

5. A razor blade assembly as set forth in claim 3 wherein said boss is cylindrical and said clip end portion has a circular opening formed therein for receiving said boss.

6. A razor blade assembly as set forth in claim 1 wherein said body member contains at least one other pair of slotted openings formed therein at said opposite side portions of said body member, said pair of slotted openings having a second razor blade disposed therein.

7. A razor blade assembly as set forth in claim 6 which further includes spring fingers formed in said body member for spring-biasing said razor blades by contacting each of said razor blades to force said blades upwardly into contact with each of said clips.

8. A razor blade assembly as set forth in claim 6 wherein said means for inhibiting said movement of a said pair of clip end portions comprises an interfitting engagement between a clip end surface and said body member bottom surface, one of said surfaces having a contoured boss extending outwardly therefrom and a corresponding contoured opening formed in the surface of the other for receiving said boss.

9. A razor blade assembly as set forth in claim 8 wherein said boss is formed on said body member bottom surface and said contoured opening is formed in said clip end portion.

10. A razor blade assembly as set forth in claim 9 wherein said boss is formed of a cylindrical surface extending toward, and received in one edge of said clip end portion.

11. A razor blade assembly as set forth in claim 10 which further includes spring fingers formed in said body member for spring-biasing said razor blades by contacting each of said razor blades to force said blades upwardly into contact with each of said clips.

12. A razor blade assembly as set forth in claim 1 wherein means for inhibiting movement of a said pair of clip end portions comprises a slot formed in said body member bottom surface in the longitudinal direction of said blade and wherein said clip end portion is formed for interfitting engagement in said slot.

* * * * *